US006137059A

United States Patent [19]

Quiroz

[11] Patent Number: 6,137,059

[45] Date of Patent: Oct. 24, 2000

[54] GROUND PLANE CABLE

[75] Inventor: David Quiroz, Covina, Calif.

[73] Assignee: Hon Hai Precision Ind. Co., Ltd., Taipei Hsien, Taiwan

[21] Appl. No.: 09/222,435

[22] Filed: Dec. 28, 1998

[51] Int. Cl.[7] ..... H01B 11/02

[52] U.S. Cl. ..... 174/113 R; 174/36; 174/117 F

[58] Field of Search ..... 174/117 F, 117 FF, 174/115, 114 R, 113 R, 36

[56] References Cited

U.S. PATENT DOCUMENTS

| | | | |
|---|---|---|---|
| 4,218,581 | 8/1980 | Suzuki | 174/117 F |
| 4,513,170 | 4/1985 | Apodaca | 174/36 |
| 4,650,924 | 3/1987 | Kauffman et al. | 174/117 F |
| 4,678,864 | 7/1987 | Cox | 174/36 |
| 4,698,457 | 10/1987 | Bordbar | 174/36 |
| 4,707,671 | 11/1987 | Suzuki et al. | 333/1 |
| 4,818,820 | 4/1989 | LaRock | 174/36 |
| 5,008,490 | 4/1991 | Strauss et al. | 174/36 |
| 5,235,132 | 8/1993 | Ainsworth et al. | 174/36 |
| 5,446,239 | 8/1995 | Mizutani et al. | 174/36 |

*Primary Examiner*—Dean A. Reichard
*Assistant Examiner*—William H. Mayo, III
*Attorney, Agent, or Firm*—Wei Te Chung

[57] ABSTRACT

A ground plane cable has a layer of first conductors. A layer of second conductors is arranged in parallel to the first conductors. A grounding plate is arranged between the first and second conductors. Each layer of first and second layer of conductors has at least a conductor electrically contacting with the grounding plate.

5 Claims, 1 Drawing Sheet

GROUND PLANE CABLE

FIELD OF THE INVENTION

The present invention relates to a cable, and more particularly to a ground plane cable for high-speed signal transmission.

DESCRIPTION OF PRIOR ART

A conventional ground plane cable includes a plurality of conductors arranged in a common plane. Each conductor is coated with a layer of insulation. A metal layer is attached to the conductors and at least one of the conductors is grounded to the metal layer. When the ground plane cable is terminated with a connector, a portion of the metal layer will be cut away.

Conventionally, a ground plane cable is used between two devices. When the number of devices increases, the number of cables is also increased. However, space within a computer housing is too small to accommodate additional cables.

SUMMARY OF THE INVENTION

An objective of this invention is to provide a ground plane cable having at least two sets of conductors for facilitating different high-speed signal transmission.

In order to achieve the objective set forth, a ground plane cable comprises a layer of first conductors. A layer of second conductors is arranged in parallel to the first layer of conductive conductors. A grounding plate is arranged between the first and second layer of conductors. Both layers of the first and second conductors have at least a conductor electrically contacting with the grounding plate.

These and additional objectives, features, and advantages of the present invention will become apparent after reading the following detailed description of the preferred embodiment of the invention taken in conjunction with the appended drawings.

DETAILED DESCRIPTION OF PREFERRED EMBODIMENT

Figure 1:
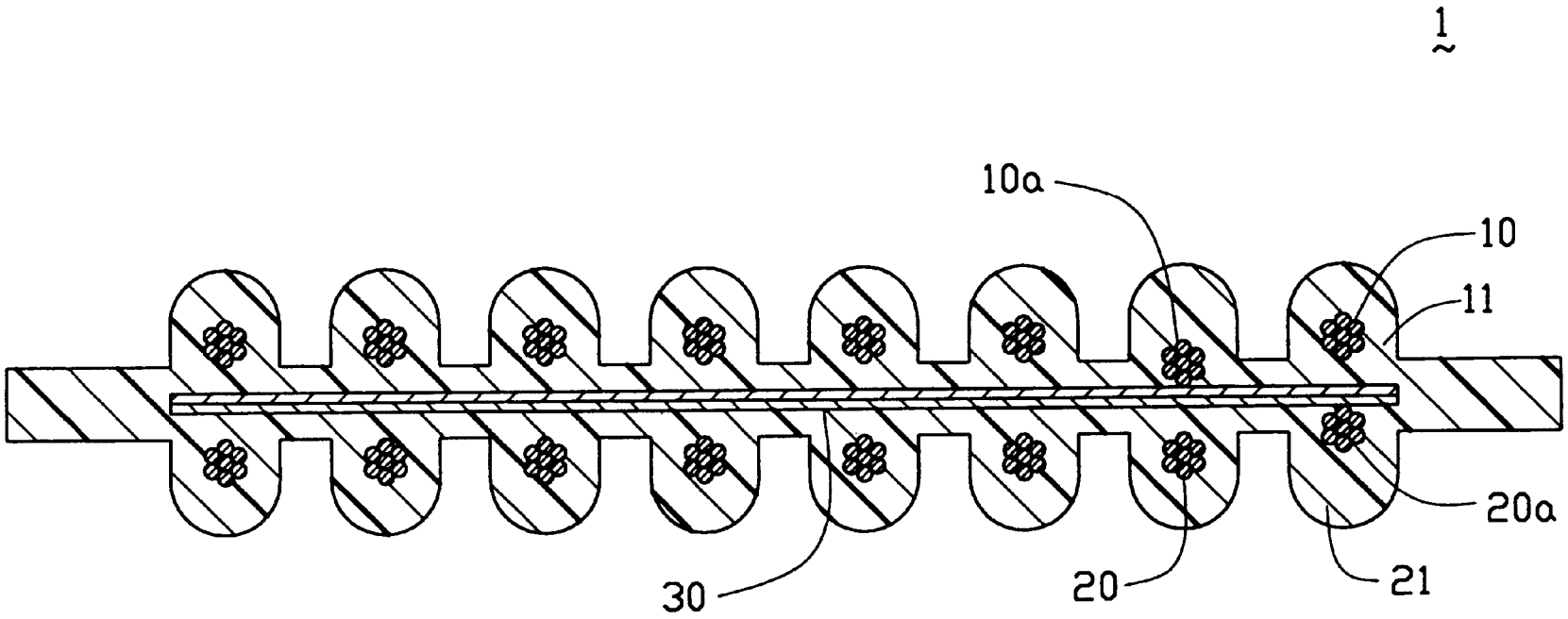
FIG. 1 is a cross sectional view of a ground plane cable in accordance with the present invention.

Referring to FIG. 1, a ground plane cable 1 in accordance with the present invention includes a layer of first conductors 10 arranged in parallel. Each first conductor 10 is coated with insulation 11. The ground plane cable 1 includes a layer of second conductors 20 opposite the first layer of conductors 10. Each second conductor 20 is also coated with insulation 21. A metal plate 30 is arranged between the first and second conductors 10, 20. In this embodiment, the metal plate 30 is a copper mesh. Each layer of first and second of conductors 10, 20 has at least a conductor 10*a* (20*a*) electrically contacting with the metal plane 30. Since the first and second conductors 10, 20 share the metal plate 30 for grounding, the overall configuration is simplified.

In operation, the first layer of conductors 10 can be assigned to a first set of devices while the second layer of conductors 20 can be assigned to another set of devices. Since the termination of the cable is similar to the prior art, a detailed description thereof is omitted herein.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

What is claimed is:

1. A ground plane cable, comprising a layer of first conductors;

a layer of second conductors arranged in parallel to said layer of first conductors; and a grounding plate arranged between said layers of first and second conductors, each of said layers of first and second conductors having at least a conductor electrically contacting said grounding plate on two opposite surfaces of said grounding plate, allowing said layers of first and second conductors to share a same grounding plane formed by said grounding plate, thereby simplifying the overall configuration compared with two separate ground plane cables with respectively a similar layer of first conductors and a similar layer of second conductors.

2. The ground plane cable as recited in claim 1, wherein said grounding plate is a copper mesh.

3. The ground plane cable as recited in claim 1, wherein each conductor of said layers of the first and second conductors, is coated with an insulative material.

4. A ground plane cable comprising a grounding plate sandwiched between a first layer of plural juxtaposed first conductors and a second layer of plural juxtaposed second conductors wherein each of said first and second layers includes insulation enclosing the first and the second conductors, the first and second layers of first and second conductors share the grounding plate for grounding, at least one of the first conductors and at least one of the second conductors electrically contact with two opposite surfaces of the grounding plate, respectively, and said at least one of the first conductors and said at least one of the second conductors electrically contact only said grounding plate.

5. A method for providing a grounding plane for conductors of a cable, comprising the steps of:

providing a first layer of plural juxtaposed first conductors on a first plane;

providing a second layer of plural juxtaposed second conductors on a second plane; and providing a grounding plane on a third plane to electrically contact with at least one of the first conductors and at least one of the second conductors wherein said first layer of first conductors and said second layer of second conductors can share the grounding plane with each other while being positioned on opposite surfaces of said grounding plane, and said at least one of the first conductors and said at least one of the second conductors are electrically connected to only said grounding plate.

* * * * *